US007892990B2

(12) United States Patent
Douglas

(10) Patent No.: US 7,892,990 B2
(45) Date of Patent: Feb. 22, 2011

(54) PRESS PADS

(75) Inventor: Melvyn Douglas, Rochdale (GB)

(73) Assignee: Marathon Belting Limited, Rochdale (GB)

( * ) Notice: Subject to any disclaimer, the term of this patent is extended or adjusted under 35 U.S.C. 154(b) by 689 days.

(21) Appl. No.: 11/722,714

(22) PCT Filed: May 1, 2007

(86) PCT No.: PCT/GB2007/001597

§ 371 (c)(1),
(2), (4) Date: Jul. 23, 2007

(87) PCT Pub. No.: WO2007/129041

PCT Pub. Date: Nov. 15, 2007

(65) Prior Publication Data

US 2008/0311811 A1 Dec. 18, 2008

(30) Foreign Application Priority Data

May 3, 2006 (GB) ..... 0608677.1

(51) Int. Cl.
*D03D 15/00* (2006.01)

(52) U.S. Cl. ..... 442/200; 442/184; 442/199; 442/208

(58) Field of Classification Search ..... 442/184, 442/199, 200, 208
See application file for complete search history.

(56) References Cited

U.S. PATENT DOCUMENTS

| | | | | |
|---|---|---|---|---|
| 2,372,114 | A | 3/1945 | Perry et al. | |
| 5,855,733 | A * | 1/1999 | Douglas et al. | 156/583.1 |
| 6,737,370 | B2 * | 5/2004 | Espe | 442/200 |
| 2001/0029139 | A1 | 10/2001 | Espe | |
| 2003/0104094 | A1 | 6/2003 | Sloman | |

FOREIGN PATENT DOCUMENTS

| | | |
|---|---|---|
| DE | 2405975 | 8/1975 |
| EP | 0290653 | 11/1988 |
| EP | 0292700 | 11/1988 |
| EP | 0920983 | 6/1999 |
| EP | 1300235 | 4/2003 |

* cited by examiner

*Primary Examiner*—Lynda Salvatore
(74) *Attorney, Agent, or Firm*—Egbert Law Offices PLLC

(57) ABSTRACT

A press pad is provided for use in a laminate press. The pad includes a woven fabric of heat resistant strands wherein at least either the warp or the weft has a core made up of a plurality of strands within a sheath of an elastomeric material, and the other is made up of metal strands. Within the scale of the press pad, the strands making up the core lie substantially parallel to one another and to the longitudinal axis of the core. In use, therefore, when pressurized in the laminate press, the core structure collapses as the strands making up the core move relative to one another and the core tends to flatten out. This increases the springiness and compensation ability of the press pad without any loss of heat transfer ability.

15 Claims, 5 Drawing Sheets

PRESS PADS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a press pad for use in a laminating press for the production of laminate sheets, such as decorative laminates, laminated floorboards, and printed circuit boards, using low pressure and high pressure single daylight and multi-daylight presses.

2. Description of Related Art Including Information Disclosed Under 37 CFR 1.97 and 37 CFR 1.98.

The purpose of a press pad is to compensate for density variations in the laminate sheet being pressed and thereby to ensure that an equal pressure is applied to all parts of the sheet. In addition, the press pad compensates for any unevenness in the surfaces of the platens of the press itself and any flexure or bowing of the platens when under pressure. Again, this assists in the production of a flat even density laminate. Thus, it is important for a press pad to be resilient and have a natural springiness to permit it to compensate for the aforementioned density variations and the surface unevenness of the press platens but also to allow it to relax after each pressing operation and recover its form to enable it to be used again. The capacity a press pad has to re-form itself after each pressing is an important characteristic to ensure a reasonable working life and to avoid unnecessary downtime of a press while press pads are replaced.

Typically, therefore, a conventional press pad is a densely woven combination of high temperature resistant non-asbestos yarns and metal wire. The metal wire is included to give good heat transmission through the pad to the laminate sheet. In contrast, the non-metal yarn is required to give the pad the springiness and resilience required to enable the pad to relax after each pressing operation. The relative proportion of the two types of material is a consideration when devising a press pad for a particular purpose. Usually a compromise must be reached between the heat transference and the resilience or springiness required in each case.

A conventional press pad is described in European Patent No. 0 735 949 A1. The pad comprises a woven fabric of heat resistant strands such as copper wires, wherein a substantial proportion of either the warp or the weft comprises a silicone elastomer. In practice, as shown in FIG. 1, the warp 1 usually comprises stranded or bunched brass or copper wire and the weft 2 usually comprises a silicone covered metal wire. In particular, a sheath 4 of silicone has been extruded over a stranded or bunched copper wire 3. As a result of the presence of the silicone 4, this press pad has great resilience and springiness, while the metal wires ensure that the press pad achieves good heat transference from the platens to the material being pressed.

Hitherto, the copper wire covered by the silicone sheath has been copper wire comprising seven individual strands of 0.2 mm diameter that have been stranded or bunched. Stranded wire comprises a wire wherein the strands are subjected to a positive and controlled twisting with one of the seven strands forming a core around which the other six strands are wrapped. Such a wire 5 is illustrated in FIG. 2, wherein a strand forming the central core 6 is shown surrounded by six strands 7 that have been twisted around it. If the strands 6, 7 each have a diameter of 0.2 mm, then it can be seen that the overall wire diameter d1 (see FIG. 1) is 0.6 mm. In contrast, bunched wire comprises a wire wherein the strands are twisted in a more random fashion without any of them having the center position. Such a bunched wire also has an overall diameter of approximately 0.6 mm if seven single strands of 0.2 mm are used. The degree of twist used in the stranded or bunched wire of both the warp 1 and the weft 2 is typically of the order of '15 mm lay'. This represents the length of finished wire required for a 360° twist in the twisted strands.

When coated with silicone, the outside diameter d2 of the silicone-covered weft 2 is typically 1.4 mm, thus making the wall thickness d3 of the silicone 0.4 mm. Typically, the woven press mats using such silicone-covered wire have an initial thickness T1 (see FIG. 1) of 2.5 mm but after a relatively short use they settle to a thickness of around 2.0 mm. This is because the warp wires are pushed into the silicone of the weft. In this state, a press pad may typically achieve 200,000 press cycles before it becomes spent. The pad wears out because, in use, the weave structure is eventually flattened to such an extent that the press pad is unable to relax after each pressing operation, and the pad loses its resilience and springiness.

Press pads are used in presses exerting an average specific pressure of around 35 kg per $cm^2$ so that the total download on one square meter of press pad material is 350,000 kg. A typical press pad has around 550 weft insertions per meter of length and 900 warp threads per meter of width. This means that there are typically 550×900=495,000 crossover points per square meter of press pad, each being subjected, in use, to a download of around 0.707 kg during each compression cycle of the press. During use, at each crossover point the warp wire 1 fairly quickly cuts through the silicone coating 4 of the weft 2 and, before deformation of the crossing wires owing to the applied pressure, there are two wires 1, 3 each of 0.6 mm touching each other. This is shown schematically in FIG. 3 without any silicone being depicted. Over time, during continued use of the press pad, the two crossing wires 1, 3 become compressed into each other and their total thickness of 0.6 mm+0.6 mm=1.2 mm might reduce to around 0.8 mm. This is a typical final thickness of a press pad once it has been spent and it has ceased to act as a flexible compensation mat. The silicone has, by then, been pressed into the interstices between the wire mesh formed by the crossing wires 1, 3 and the wire crossover points support the total download.

The number of pressing cycles which has to occur before a conventional pad similar to that described above becomes worn out is dependent to a very large degree upon the nature of the laminated sheets being pressed. Decorative laminates have an inherent springiness and resilience so that during a pressing operation they also assist in providing the compensation required. However, laminated floorboards made from medium and high density fiberboard have very little natural springiness and it has been found that conventional press pads as described above wear out relatively quickly when used for pressing these types of laminates.

It is an object of the present invention to provide a press pad which will retain its springiness and compensation ability for a greater number of pressing cycles than a conventional press pad without any loss of heat transfer ability.

BRIEF SUMMARY OF THE INVENTION

According to the present invention there is provided a press pad for use in a laminate press comprising a woven fabric of heat resistant strands wherein at least the warp and/or the weft comprises a core made up of a plurality of strands within a sheath of an elastomeric material and at least the other of the warp or the weft comprises metal strands and characterized in that the strands making up the core lie substantially parallel to one another and to the longitudinal axis of the core.

It should be appreciated that the requirement that the strands making up the core lie substantially parallel to one another and to the longitudinal axis of the core should be understood within the scale of the press pad. The core may, therefore, comprise a bundle of strands that have been loosely stranded or bunched.

Preferred additional features of the invention are described in the dependent claims appended hereto.

BRIEF DESCRIPTION OF THE SEVERAL VIEWS OF THE DRAWINGS

The present invention will now be described by way of example with reference to the accompanying drawings.

DETAILED DESCRIPTION OF THE INVENTION

A press pad according to the present invention is similar to the prior art in that it comprises a woven fabric of heat resistant strands wherein at least either the warp or the weft comprises a core made up of a plurality of strands within a sheath of an elastomeric material. The difference between the prior art and the present invention lies in the structure of the strands that are covered with the elastomeric sheath. In the following description, the strands covered with the elastomeric sheath will be described as the weft strands and the other strands as the warp strands, but it should be appreciated that the opposite could be the case with the strands covered with the elastomeric material being used in the warp. It is also possible for such strands to be used in both the warp and the weft. Apart from these strands, other types of strands could also be incorporated into the press pad, for example non-metal strands, such as aromatic polyamide yarns, polyester yarns and glass strands as well as wire wrapped polyamide yarns. In addition, mixed threads such as copper or stainless steel strands wrapped with an aromatic polyamide yarn in a conventional manner could also be used.

It should also be appreciated that the elastomeric sheath need not necessarily be made of silicone, as described in EP 0 735 949 A1, but may comprise any elastomeric material such as rubber. Preferably, however, the sheath comprises a siloxane, such as silicone or a fluoro-silicone. The sheath may be applied to the core using any suitable process. In most cases the sheath will be formed by extrusion of the elastomeric material over the core in a conventional manner.

The strands of the core are preferably metal strands but may comprise any of the following, namely copper wires, brass wires, stainless steel wires, copper alloy wires, aramide yarns, glass strands or filaments, and aromatic polyamide yarns. The choice of strands used will depend on the purpose of the press pad, the desired degree of heat transference and resilience or springiness required. The warp must also be chosen with the intended purpose of the press pad in mind. The warp weaves around the weft from the top to the bottom of the pad. It therefore forms the main conduit for heat transfer through the pad. For this reason, the warp usually comprises metal strands and may take the form of metal wires, in particular wires made from copper, brass or other copper alloys which all have a high heat conductivity.

Figure 1:
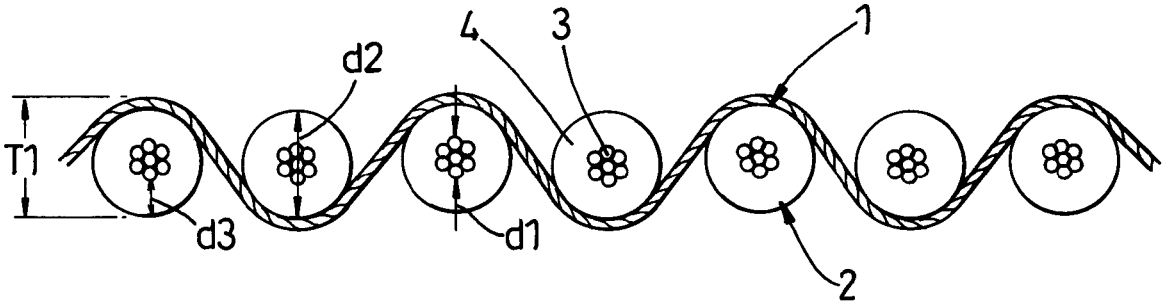
Fig. 1 (PRIOR ART)
FIG. 1 is a cross sectional view, to an increased scale of a conventional press pad prior to any use.
Figure 2:
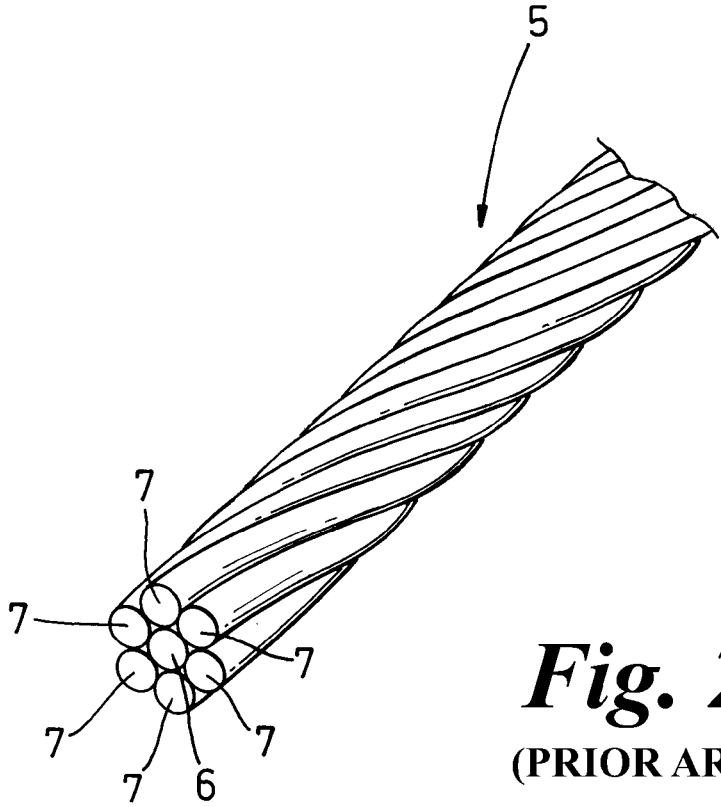
Fig. 2 (PRIOR ART)
FIG. 2 is a perspective view of a length of a metal core of the weft strands forming part of the press pad shown in FIG. 1.
Figure 3:
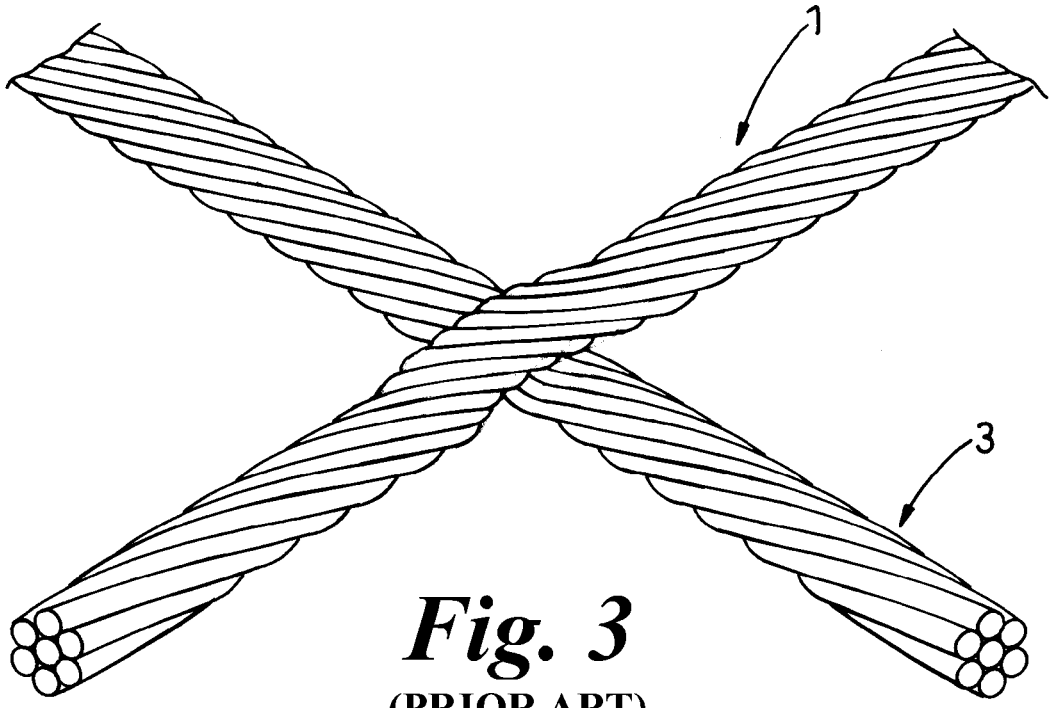
Fig. 3 (PRIOR ART)
FIG. 3 is a schematic view of a crossover point between a metal core of a weft strand and a warp strand of the press pad shown in FIG. 1, the silicone of the press pad having been omitted.

An embodiment of a press pad according to the invention may appear similar in cross section to that depicted in FIG. 1 wherein the warp 1 comprises metal wire and the weft 2 comprises threads with a core 3 of individual strands surrounded by a sheath 4 of an elastomeric material. However, as indicated above, the structure of the weft is different from that of the prior art and various embodiments thereof will now be described in greater detail with reference to FIGS. 5 to 9.

Figure 5:
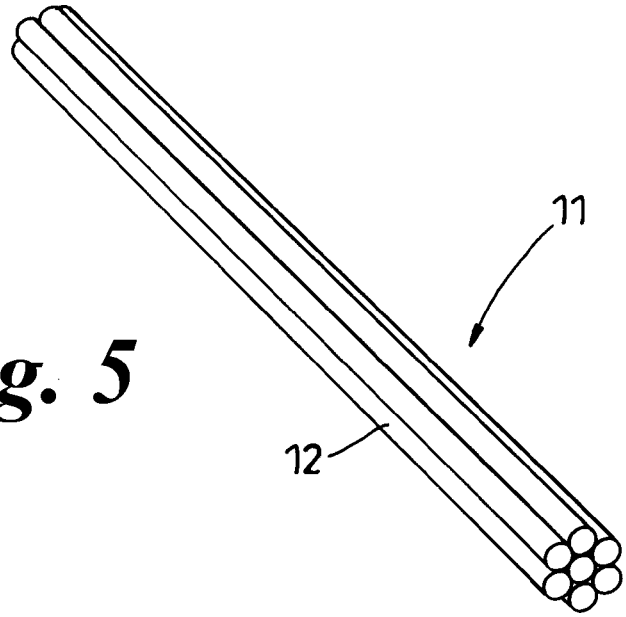
FIG. 5 is a perspective view of a length of a metal core of the weft strands forming part of a press pad in accordance with the present invention.
Figure 6:
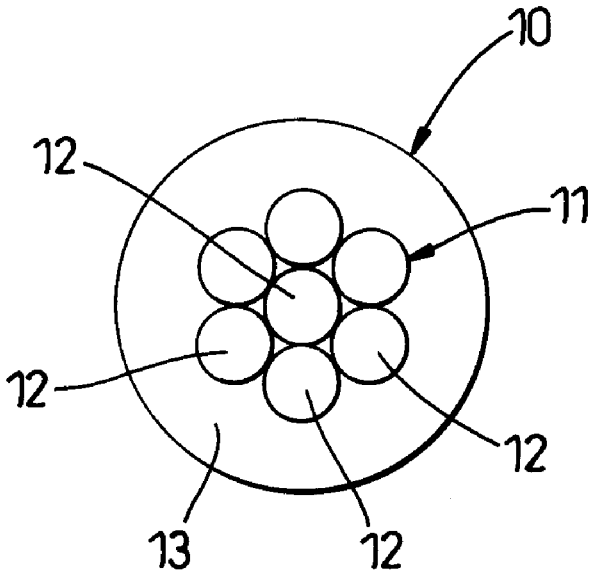
FIG. 6 is a cross sectional view of a first embodiment of weft strand forming part of a press pad in accordance with the present invention and comprising a metal core as shown in FIG. 5 and prior to use.

With reference to FIGS. 5 and 6, in a first embodiment, the weft threads 10 comprise a core 11 of metal wire made from a plurality of substantially parallel metal strands 12 that have not been significantly twisted together within a sheath 13 of an elastomeric material. The structure of the core 11 is as shown in FIG. 5. As can be seen here, the strands 12 making up the core form a bundle wherein they are all substantially parallel both to one another and to the longitudinal axis of the core 11. Preferably, the strands 12 have not been stranded or bunched but it will be appreciated that if the lay is sufficiently long in comparison to the width of the press pad, it is possible to use a core 11 where the strands 12 have been loosely stranded or bunched but wherein within the scale of the press pad they appear substantially parallel to one another.

Figure 7:
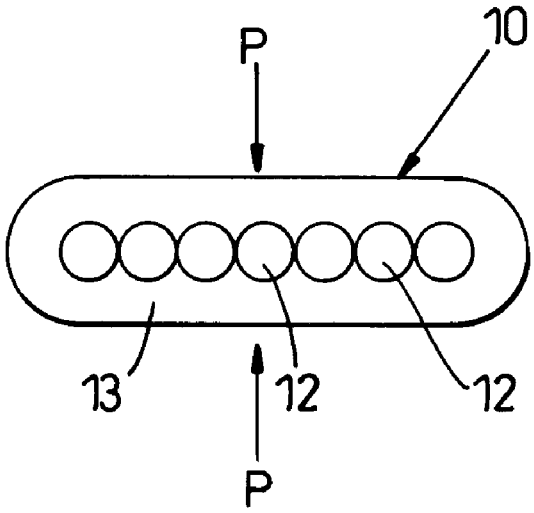
FIG. 7 is a sectional view similar to FIG. 6 but showing the weft strand when in use and under pressure.
Figure 8:
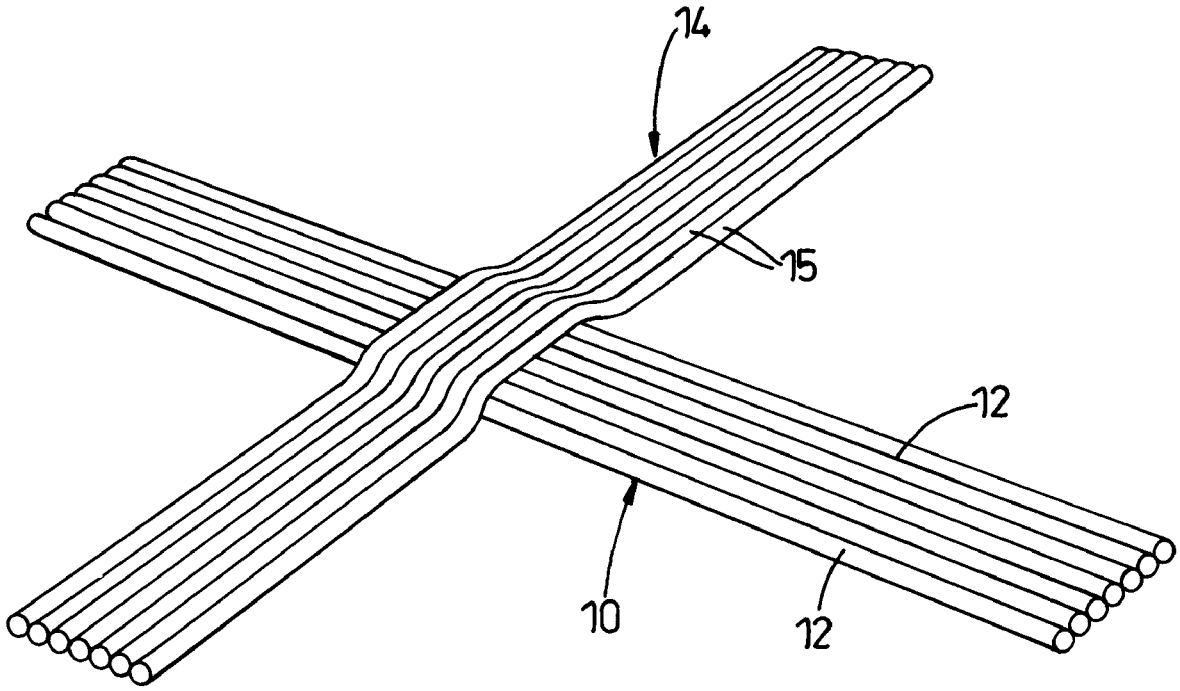
FIG. 8 is a schematic view similar to FIG. 3 but of a press pad in accordance with the present invention.

The point of ensuring that the strands 12 lie substantially parallel becomes clear when the press pad is in use as when pressurized in a laminate press by pressure applied in the direction of the arrows P, as shown in FIG. 7. The strands 12 within the core 11 can move relative to one another and therefore tend to flatten out as shown in FIG. 8. In contrast, in the prior art, the core 6 is unable to flatten when pressurized because of the twisted nature of the strands 12 and the shortness of the lay. Its thickness after initial distortion remains the same even when under the considerable pressure of the laminate press.

If seven parallel strands 12 are used within the core 11 instead of seven twisted strands as is used in a prior art press pad, the application of nominal pressure causes the core 11 to flatten to a total thickness of 0.2 mm. Similarly, if the warp threads 14 also comprise a plurality of substantially parallel metal strands 15, say seven parallel strands, then they also flatten under pressure in use to a total thickness of 0.2 mmm. As shown schematically in FIG. 8 without the elastomeric material, each crossover point between the warp 14 and the weft 10 brings together wires that each have a thickness of 0.2 mm so that the total wire thickness at the crossover points is only around 0.4 mm compared with around 1.2 mm in the prior art. Also, the total number of crossover points between the metal strands used in the pad is significantly increased. In a press pad with 550 weft insertions per meter of length and 900 warp ends per meter of width, there are now (550×7)×(900×7)=24,255,000 crossover points per square meter. In a typical press, this reduces the download at each crossover point during use by 98% to 0.01443 kg, i.e. 350,000/24,255,000). Another way to look at this is that every crossover point that previously had 1×1 wire now has 7×7 wires=49 crossover points. This is an increase of 98%.

A warp with the aforementioned structure, wherein each warp thread 14 comprises a plurality of substantially parallel metal strands 15, can be difficult to work with. Preferably, therefore, the warp comprises metal strands 15 each having a diameter of the order of 0.2 mm with a lay of at least 25 mm. Such a lay is an improvement on the conventional lay of 15 mm but the greater the lay, and therefore the least amount of twist in the metal strands 15, the better.

In practice, in a woven press pad, the warp travels over and under the weft. In a press pad, wherein the warp threads 14 have seven substantially parallel metal strands 15, the effect of pressure on the press pad will be to push the parallel warp strands 14 into the elastomeric sheath 13 a distance equivalent to their individual diameter of 0.2 mm before the surface of the warp becomes level with the surface of the weft. This amounts to half the available wall thickness of the sheath if a conventional wall thickness of around 0.4 mm is used, hence leaving around 0.2 mm as a cushion between the warp and weft threads. This cushion enables the individual 0.2 mm diameter warp strands 14 to bed comfortably into the sheath and this gives them protection. In the prior art, a twisted warp of 0.6 mm overall diameter would be pressed into the sheath a distance of around 0.6 mm but as the wall thickness of the sheath is only around 0.4 mm this means that the sheath is readily cut through and the metal wire threads of the warp and weft are brought almost immediately into contact with each other when the press pad is used.

The reduction in the thickness of the metallic core 11 during compression as compared to the prior art has two advantageous effects. First, the thickness of the pad itself during compression is significantly less than prior art pads and consequently the face of the heated platen of a laminate press is brought marginally closer to its caul plate. This therefore increases the transfer of heat to the laminate being pressed. Second, the aforesaid cushion of elastomeric material improves recovery of the press pad after compression so that the compensation ability of the pad is improved. However, as the pad has the same number of warp threads passing from the top surface to the bottom surface of the pad, the inherent heat transfer capabilities of the pad will be unaffected. These advantage effects will now be considered in more detail.

Figure 4:
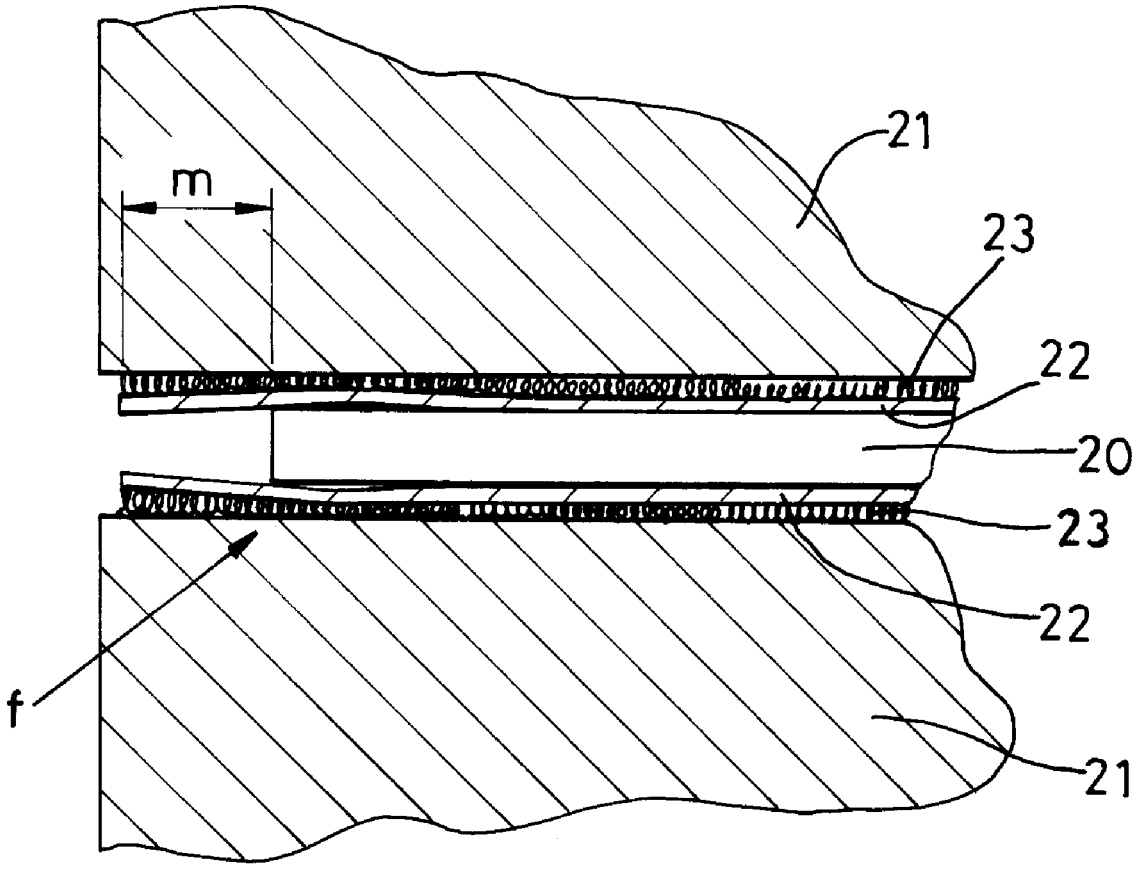
Fig. 4 (PRIOR ART)
FIG. 4 is a schematic view of a vertical section through a laminate press showing flexure of caul plates within the press when using conventional press pads.

As shown in FIG. 4, in a conventional laminate press, a board 20, which is to be pressed between two platens 21 of the press, is located between two metal caul plates 22 and two press pads 23. The press pads 23 are each located between one of the caul plates 22 and one of the platens 21. The caul plates 22 and the press pads 23 are usually larger in width and length than the board being pressed. This creates a margin area m of unsupported caul plate 22 which receives pressure from the press platens 21 transmitted through the press pads 23. Because there is no support for the caul plate 22 around the margin of the board 20, the caul plates 22 tend to bend using the edges of the board 20 as a fulcrum, as indicated by arrow f. This effect causes defects called 'white spots' on the board because of the abnormally high pressure along its edges that act as fulcrums and the resulting lower pressure that occurs typically within 5 cm of the edge of the board 20 because of the bending of the caul plates 22 away from the board 20. This problem is exacerbated at the corners of the board 20 where lengthways and widthways margins meet. This causes high pressure on the corner of the board 20 and a corresponding drop in pressure in the small area, typically within 5 cm to 10 cm, of the corner of the board 20. The 'white spots' occur where the board 20 has received insufficient pressure to complete the pressing process satisfactorily.

It will be appreciated that the bending moment applied to each unsupported caul plate 22 is commensurate with the difference in thickness between the pressed press pad 23 above and below the board 30 and the lightly pressed press pad 23 mat in the margin area m. Generally, this difference in thickness, as a linear measure, will vary in direct proportion to the thickness of the press pad 23 being used. Consequently, a press pad with a reduced thickness will have a reduced 'difference in thickness' between its pressed area and the margin area m and therefore produce a reduced bending effect on the unsupported caul plate area. It follows that it is advantageous to produce press pads such as those according to the present invention that have a reduced thickness as compared to a conventional pad provided there is no reduction in the compensation ability of the mat. However, the press pads of the present invention also improve the recovery of the press pad after compression so that the compensation ability of the pad is improved. This advantage will now be considered in further detail.

As mentioned above, it is usually the case that a compromise must be reached between the heat transference and the resilience or springiness of any given press pad according to its required use. However, the increased recovery after compression of the press pad of the present invention means that a new compromise can be considered wherein the outside diameter of the elastomeric sheath is reduced from a conventional 1.4 mm to, say, 1.15 mm instead. If, at the same time, the seven parallel strands 12 of the core 11 are replaced by three parallel strands (see below) then the reduction in volume of the sheath material per weft insertion amounts to approximately 27%. This can result in a considerable saving in the cost of the sheath material, particularly if an expensive material such as fluoro-silicone is used. However, a reduction in the thickness of the weft threads 10 means that the number of weft insertions per meter could be increased from approximately 600 to approximately 710, an increase of 18%. This has two beneficial effects. First, as the warp winds around the weft and forms the 'through pad' heat conductors, then the total number of 'through pad' conductors is increased in the same ratio. This will, therefore, improve the heat transfer capability of the pad and enable the cycle time of the press to be reduced. Second, an increase in the number of weft insertions by 18% offsets the reduction of springiness of the pad caused by the reduction in the diameter of the elastomeric sheath. The net overall amount of elastomeric material in the pad is still reduced by 14% but as a result of the novel structure of the weft, the pad exhibits the same level of springiness and has the same compensation ability as before but with an improved heat transfer.

In another embodiment of the weft, instead of seven parallel strands 12 being used to form the core 11, three parallel strands 12 could be used instead. It is expected that in most cases, the seven parallel strands 12 will comprise copper wires. However, a similar strength to such a multi-stranded core 11 can be achieved by using three stainless steel strands 12 to form the core 11. The use of stainless steel in this way has the advantage that it overcomes any problems that may be encountered with metal fatigue owing to the springiness of the pad.

Figure 9:
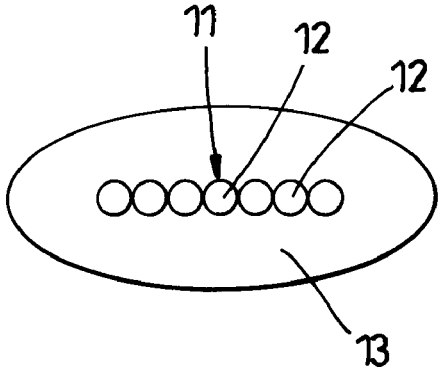
FIG. 9 is a sectional view similar to FIG. 6 but of another embodiment of weft strand.

The embodiments of weft in accordance with the present invention as described above all have a core 11 comprising a bundle of substantially parallel strands as shown in FIG. 6 that collapses when under pressure so that the strands 12 move relative to one another and flatten out as shown in FIG. 7. In another embodiment of weft, as shown in FIG. 9, the strands 12 are arranged to lie substantially parallel to one another and to the longitudinal axis in substantially the same plane of the core 11 when they are not under any applied pressure. This will involve the extrusion of the elastomeric sheath 13 in a non-circular cross sectional profile. Such an extrusion will require an appropriately shaped die to be used, preferably an elliptical die as shown in FIG. 9, although it may be possible to use other shapes, for example a square or rectangular shape. It is also possible for the strands 12 to be arranged in rows in a matrix rather than in a single plane.

It can appreciated from the foregoing that the present invention provides a press pad that retains its springiness and compensation ability for a greater number of pressing cycles than a conventional press pad without any loss of heat transfer ability. Also, pads can be produced with an increased quantity of elastomeric material and, therefore, an enhanced compensation ability again without any reduction in the heat transfer capability of the pad. Generally, press pads are replaced during use when their compensation properties are lost because of the inability of the elastomeric material to recover. The greater degree of compensation achieved with pads of the present invention is an advantage in itself but it also extends the life of the pad for the following reasons.

1. The elastomeric material remains intact for a longer period because the metal strands in the warp do not cut into it.

2. The quantities of metal wire used in the pad can be the same as in the prior art but the overall thickness of the metal wire produced during use is significantly lower. This means that the elastomeric material forms a greater percentage of the overall pad thickness and therefore produces an enhanced 'spring' effect.

3. The underlying metal mesh skeleton of the pad can restrain recovery of the elastomeric material during each cycle within a press when the pressure is released. The present invention effectively forms a mesh skeleton using 0.2 mm diameter wire rather than using 0.6 mm diameter wire and such a mesh has a better inherent flexibility and produces less restraint on the recovery of the elastomeric material.

I claim:

1. A press pad for use in a laminate press comprising:

a woven fabric of heat-resistant stands having a warp and a weft, at least one of said warp and said weft having a core formed of a plurality of strands within a sheath, said sheath being formed of an elastomeric material, said plurality of strands lying substantially along a length thereof parallel to each other and parallel along the length thereof to a longitudinal axis of said core, the other of said warp and said weft being metal strands.

2. The press pad of claim 1, said plurality of strands of said core being loosely arranged with respect to each other.

3. The press pad of claim 1, said plurality of strands of said core lying substantially in a common plane.

4. The press pad of claim 1, said plurality of strands being arranged in rows.

5. The press pad of claim 4 said sheath having a non-circular cross-sectional profile.

6. The press pad of claim 5, said sheath having an elliptical cross-sectional profile.

7. The press pad of claim 1, said plurality of strands being formed of a material selected from the group consisting of: copper wires, brass wires, stainless steel wires, copper alloy wires, aramide yarns, glass threads, and aromatic polyamide yarns.

8. The press pad of claim 1, said plurality of strands comprising no more than seven metal strands.

9. The press pad of claim 8, each of said plurality of strands having a diameter of approximately 0.2 millimeters.

10. The press pad of claim 1, said sheath having a thickness of at least 0.2 millimeters.

11. The press pad of claim 1, said sheath having an outer diameter of at least 1.15 millimeters.

12. The press pad of claim 1, said elastomeric material being siloxane.

13. The press pad of claim 1, said other of said warp and said weft comprising a metal wire formed of said metal strands, said metal strands lying substantially parallel to one another.

14. The press pad of claim 13, each of said metal strands having a diameter of approximately 0.02 millimeters and a lay of at least 25 millimeters.

15. The press pad of claim 1, said warp having said metal strands, said weft having said core.

* * * * *